US005745822A

United States Patent [19]

Nishimura et al.

[11] Patent Number: 5,745,822

[45] Date of Patent: Apr. 28, 1998

[54] IMAGE FORMING APPARATUS INCORPORATING MECHANISM FOR AUTOMATICALLY UNSEALING TONER CARTRIDGE

[75] Inventors: Toshinori Nishimura; Hiroaki Ohashi; Mitsuharu Okada; Tohru Katamoto, all of Osaka, Japan

[73] Assignee: Mita Industrial Co., Ltd., Osaka, Japan

[21] Appl. No.: 685,949

[22] Filed: Jul. 22, 1996

[30] Foreign Application Priority Data

Jul. 31, 1995 [JP] Japan ..... 7-195351

[51] Int. Cl.[6] ..... G03G 15/08

[52] U.S. Cl. ..... 399/106; 399/13; 399/102; 399/262

[58] Field of Search ..... 399/9, 13, 24, 399/27, 102, 103, 106, 252, 258, 262; 222/DIG. 1

[56] References Cited

U.S. PATENT DOCUMENTS

| | | | |
|---|---|---|---|
| 5,030,998 | 7/1991 | Shibata et al. | 399/106 |
| 5,101,871 | 4/1992 | Susumu | 399/262 X |
| 5,142,335 | 8/1992 | Sakata et al. | 399/106 |
| 5,235,130 | 8/1993 | Demoto et al. | 399/103 |
| 5,268,720 | 12/1993 | Saitoh et al. | 399/258 X |

*Primary Examiner*—Sandra L. Brase

*Attorney, Agent, or Firm*—Beveridge, DeGrandi, Weilacher & Young, L.L.P.

[57] ABSTRACT

An image forming apparatus capable of unsealing a toner cartridge automatically and suitably as the toner cartridge is replaced with a new cartridge. The image forming apparatus includes a developing device, and a toner supplying device for supplying toner to the developing device. The toner cartridge is removably mountable on the toner supplying device. Only when the toner cartridge is mounted, and the toner cartridge has not yet been unsealed, is an operation for unsealing the toner cartridge performed.

14 Claims, 6 Drawing Sheets

IMAGE FORMING APPARATUS INCORPORATING MECHANISM FOR AUTOMATICALLY UNSEALING TONER CARTRIDGE

BACKGROUND OF THE INVENTION

1. Field of the Invention

The present invention relates to an image forming apparatus such as an electrophotographic process copying machine or a facsimile, and more particularly, to an image forming apparatus incorporating a mechanism for automatically unsealing a toner cartridge.

2. Description of the Related Art

An image forming apparatus such as an electrophotographic process copying machine generally comprises a toner supplying device for supplying toner from a toner cartridge containing toner to a developing device. The toner supplying device comprises an unsealing device for automatically unsealing a discharge opening for taking out toner of the toner cartridge, and a supplying device for supplying the toner taken out from the discharge opening to the developing device.

The unsealing device and the supplying device are operated in response to detection that cover of the copying machine is opened and then closed. That is, the sheathing cover must be opened and then closed in order to replace the toner cartridge with new one. When the outer cover is opened and then closed, therefore, the unsealing device and the supplying device are operated, assuming that the toner cartridge is replaced with new one.

In not only replacing the toner cartridge with new one but also performing paper jam processing, for example, however, the sheathing cover is opened and then closed. Consequently, the unsealing device and the supplying device may, in some cases, be uselessly operated irrespective of the fact that the toner cartridge is not actually replaced with a new cartridge. Further, a user may previously replace the toner cartridge with a new one before the toner in the developing device runs short. In such a case, if the unsealing device and the supplying device are operated in response to the opening and then closing of the sheathing cover, the toner may be excessively supplied.

SUMMARY OF THE INVENTION

A first object of the present invention is to provide an image forming apparatus capable of unsealing a toner cartridge automatically and suitably as the toner cartridge is replaced with a new one.

A second object of the present invention is to provide an image forming apparatus capable of suitably supplying toner to a developing device.

A third object of the present invention is to provide a method in which a toner cartridge can be suitably unsealed.

A fourth object of the present invention is to provide a method in which toner can be suitably supplied to a developing device.

A fifth object of the present invention is to provide a method for judging whether a toner cartridge is not yet unsealed or already unsealed.

An image forming apparatus according to the present invention comprises a developing device, and a toner supplying device for supplying toner to the developing device. The toner cartridge is for containing toner, and has a discharge opening for taking out the toner. The discharge opening is unsealably sealed. The toner cartridge is removably mountable on the toner supplying device. The image forming apparatus further comprises unsealing means for unsealing the discharge opening of the toner cartridge mounted on the toner supplying device, toner cartridge mounting detecting means for detecting that the toner cartridge is mounted on the toner supplying device, and unsealing detecting means for outputting a signal indicating whether the toner cartridge mounted on the toner supplying device has not yet been unsealed or already unsealed. The unsealing means is operated in order to unseal the discharge opening of the toner cartridge, provided that it is detected that the toner cartridge is mounted, and that the unsealing detecting means outputs a signal indicating that the toner cartridge has not yet been unsealed.

If a toner cartridge is mounted, and the toner cartridge has not yet been unsealed, the toner cartridge is a new one after replacement. If a toner cartridge has already been unsealed even if it is mounted, the toner cartridge has not been replaced with a new one. Further, if it is not detected that the toner cartridge is mounted, the toner cartridge is left removed. According to the present invention, only when the toner cartridge has been replaced with a new one, therefore, the unsealing means is operated, so that the discharge opening of the toner cartridge is unsealed. If the new toner cartridge is mounted, the unsealing means is reliably operated. Consequently, the toner cartridge can be unsealed automatically and suitably.

It is preferable that the above-mentioned image forming apparatus further comprises state outputting means for detecting whether or not the developing device is in a state where toner should be supplied thereto and outputting a signal indicating that toner should be supplied or a signal indicating that toner need not be supplied, and toner supply controlling means for driving the toner supplying device in order to supply toner to the developing device, provided that the state outputting means outputs the signal indicating that toner should be supplied.

Only when toner has run short in the developing device, therefore, toner can be supplied to the developing device, whereby it is possible to prevent the toner from being excessively supplied. That is, when the toner cartridge is replaced with a new one in a state where there is sufficient toner in the developing device, for example, the unsealing means is operated, while the toner supplying device is not operated. Even if the toner cartridge has been replaced with a new one well before the toner in the developing device runs short, therefore, no problem occurs.

In this case, it is preferable that toner is supplied to the developing device, provided that it is detected that the toner cartridge is mounted, and that the toner cartridge has not yet been unsealed.

Only when the toner cartridge is replaced, therefore, the toner supplying device can be operated. Consequently, it is possible to avoid the situation where the toner supplying device is uselessly operated irrespective of the fact that the toner cartridge is not replaced with a new one.

The above-mentioned state outputting means may comprise toner density detecting means for detecting a toner density inside the developing device, and signal outputting means for outputting the signal indicating that toner should be supplied if the toner density detecting means detects a toner density of less than a predetermined value, while outputting the signal indicating that toner need not be supplied if it detects a toner density of not less than the predetermined value.

The image forming apparatus according to the embodiment of the present invention further comprises a door which is opened when the toner cartridge is removed or mounted, and opening or closing detecting means for detecting whether the door is in the opened state or the closed state. Control of the unsealing means is started in response to the detection that the door is changed from the opened state to the closed state.

Consequently, an unsealing operation and a toner supplying operation can be performed after the door is closed upon completion of the replacement of the toner cartridge. Consequently, the unsealing means and/or the toner supplying device are not operated in the process of toner cartridge replacing work.

Specific examples of the unsealing detecting means include one for outputting the signal indicating that the toner cartridge has not yet been unsealed, until the unsealing means unseals the discharge opening upon being controlled by the unsealing controlling means, in response to the change of an output of the toner cartridge mounting detecting means from a state where it is detected that the toner cartridge is mounted to a state where it is detected that the toner cartridge is not mounted.

If a toner cartridge has been removed, it is considered that a toner cartridge to be next mounted is a new one. In a time period elapsed until the unsealing means is operated, if a toner cartridge is mounted, therefore, it can be considered that the toner cartridge has not yet been unsealed.

The toner cartridge mounting detecting means may be a switch so arranged that its actuator is operated in a state where the toner cartridge is mounted on the toner supplying device.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
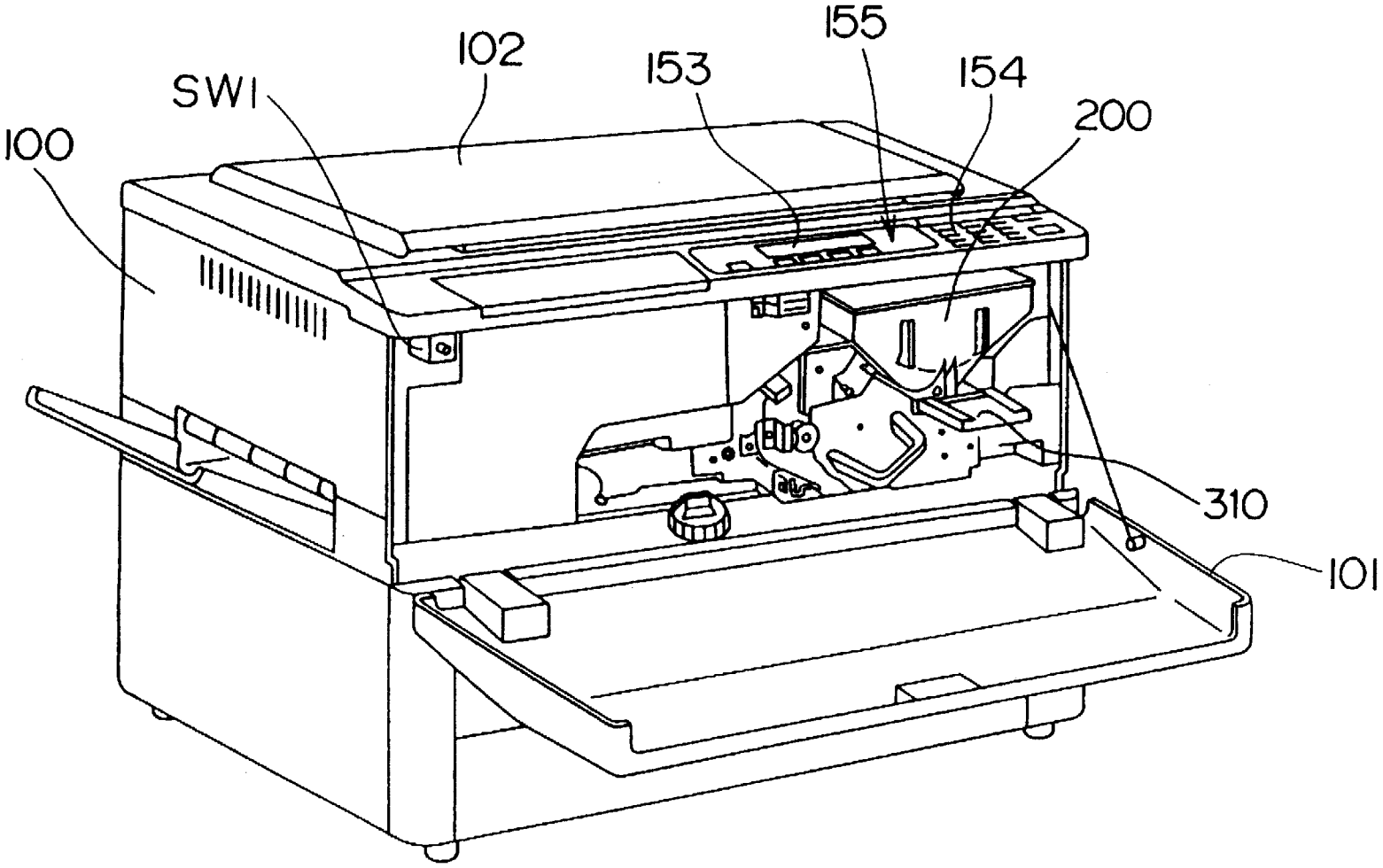
FIG. 1 is a perspective view showing a copying machine which is an image forming apparatus according to one embodiment of the present invention.

FIG. 1 is a perspective view showing a copying machine which is an image forming apparatus according to one embodiment of the present invention. The copying machine comprises a main body 100 for determining its outer shape and a door 101 provided on the front surface of the main body 100 (FIG. 1 illustrates the opened state of the door 101). Respective devices as described later which constitute the copying machine and a toner cartridge 200 are arranged inside the main body 100. The toner cartridge 200 is a removable container which can contain toner therein. Toner can be simply supplied by replacing the toner cartridge 200 itself with a new one.

The toner cartridge 200 is replaced with a new one with the door 101 opened. More specifically, the toner cartridge 200 is set in a toner supplying device 300 as described later (see FIG. 2). A guiding section 310 for guiding the toner cartridge 200 is provided in a front end of the toner supplying device 300. The guiding section 310 is constructed as such a raised-and-lowered type that it can be rotated, around its lower edge, between a containing position where it is raised upward and a guiding position where it is in a horizontal state (FIG. 1 illustrates the guiding position). The toner cartridge 200 can be removably mounted on the toner supplying device 300 by inserting and extracting the toner cartridge 200 along the guiding section 310 in the guiding position, whereby the toner cartridge 200 which has already been used can be replaced with a new one. The door 101 is closed after the toner cartridge is replaced, whereby the copying machine is made usable.

A switch SW1, which is one specific example of opening/closing detecting means for detecting the opened and closed states of the door 101, is provided inside the main body 100. Since the switch SW1 is so provided as to close a circuit in the closed state of the door 101, while opening the circuit in the opened state of the door 101, it is possible to detect the opened or closed state of the door 101 by detecting the opening or closing of the circuit.

A setting operation section 155 comprising a display device 153 and an operation key 154 is provided in a front end on the upper surface of the main body 100. A guide to an operation and a report of the abnormality can be displayed on the display device 153. The conditions of copying can be set, for example, by the operation key 154. An original cover 102 for pressing an original is provided covering the central region of the upper surface of the main body 100. The original cover 102 is rotatably mounted on the upper surface of the main body 100.

Figure 2:
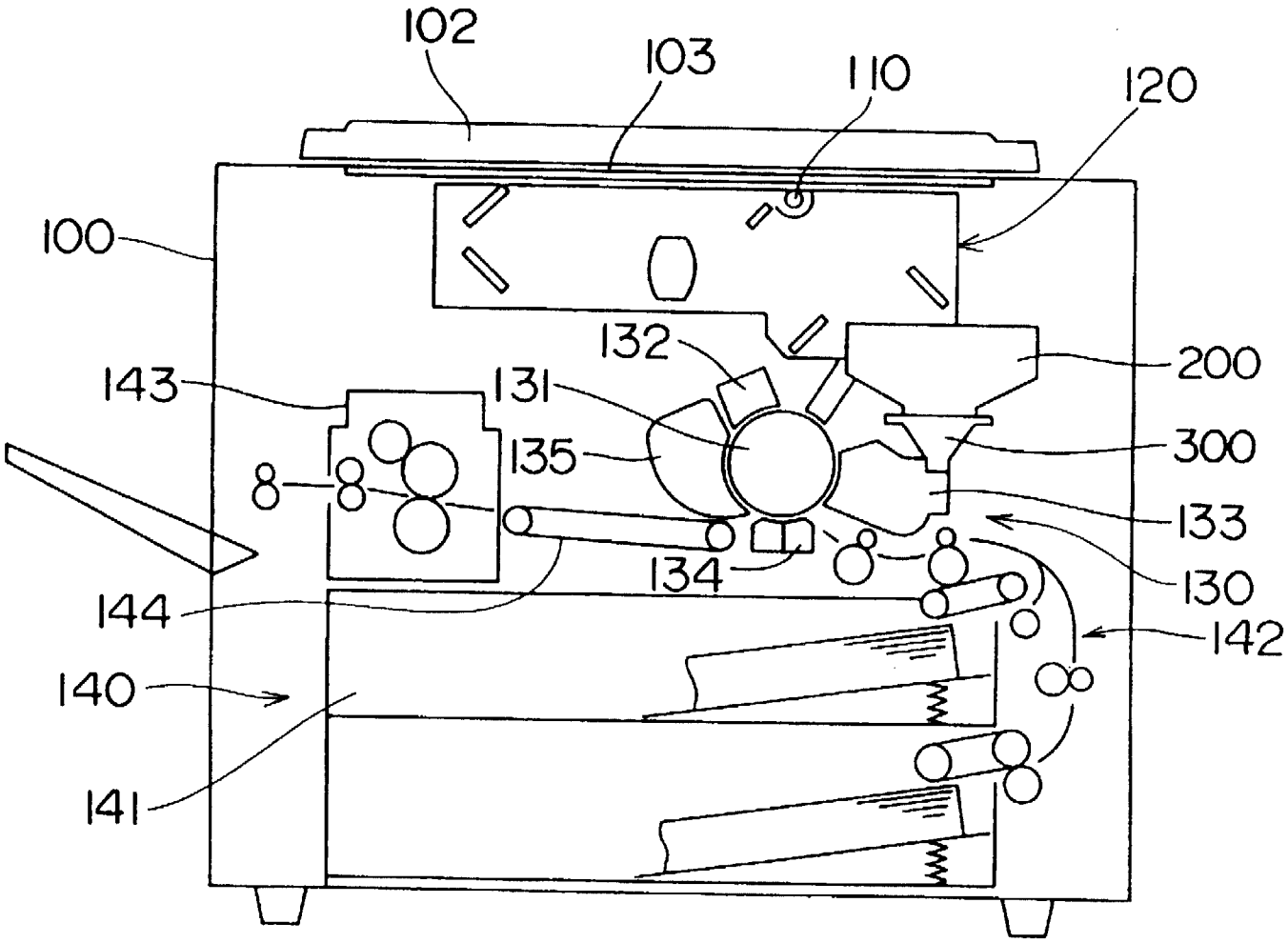
FIG. 2 is a sectional front elevation schematically showing the internal construction of the copying machine shown in FIG. 1.

FIG. 2 is a sectional front elevation showing the schematic construction of the inside of the copying machine. An original platen 103 composed of a transparent glass plate on which an original is set is provided on the upper surface of the main body 100 below the original cover 102. An illuminating unit 110 serving as a light source for illuminating the original, an optical system 120 for leading light reflected from the original to a photosensitive drum 131, an image forming section 130 for developing an electrostatic latent image formed on the photosensitive drum 131 into a toner image and then transferring the toner image on a paper sheet, and a paper conveying section 140 for conveying the paper through a conveying path leading to the outside of the main body 100 via the image forming section 130 and a fixing device 143 from a paper feeding section 141 are provided in the order from the top below the original platen 103.

The illuminating unit 110 can illuminate and scan the original on the original platen 103 by illuminating the original using a fluorescent lamp and moving back and forth (in the lateral direction in FIG. 2). Light reflected from the original is led to the image forming section 130 arranged in the center of the main body 100 by mirrors, a lens and the like provided in the optical system 120, to form a reversed image of the original on the surface of the photosensitive drum 131.

In the image forming section 130, a charging corona discharger 132, a developing device 133, a transferring corona discharger 134, and a cleaning device 135 are arranged in this order around the photosensitive drum 131. The original image is formed as described above on the outer peripheral surface of the photosensitive drum 131 which has been uniformly charged by the charging corona discharger 132, to from an electrostatic latent image. The electrostatic latent image is developed into a toner image by the developing device 133, and the toner image is transferred by the transferring corona discharger 134 to a paper sheet conveyed by the paper conveying section 140. Toner remaining on the surface of the photosensitive drum 131 after the toner image has been transferred to the paper is recovered by the cleaning device 135.

The paper conveying section 140 comprises the paper feeding section 141 for containing paper sheets below the image forming section 130, a paper feeding mechanism 142 for feeding paper sheets to the image forming section 130 from the paper feeding section 141, the fixing device 143 for fixing to a paper sheet the toner image transferred in the image forming section 130, and a paper conveying mechanism 144 for conveying paper sheets to the fixing device 143 from the image forming section 130 and discharging the paper sheets to which the toner image has been fixed to the outside of the main body 100.

The toner supplying device 300 for supplying toner to the developing device 133 from the toner cartridge 200 is connected to the developing device 133. The toner cartridge 200 is mounted on the toner supplying device 300.

Figure 3:
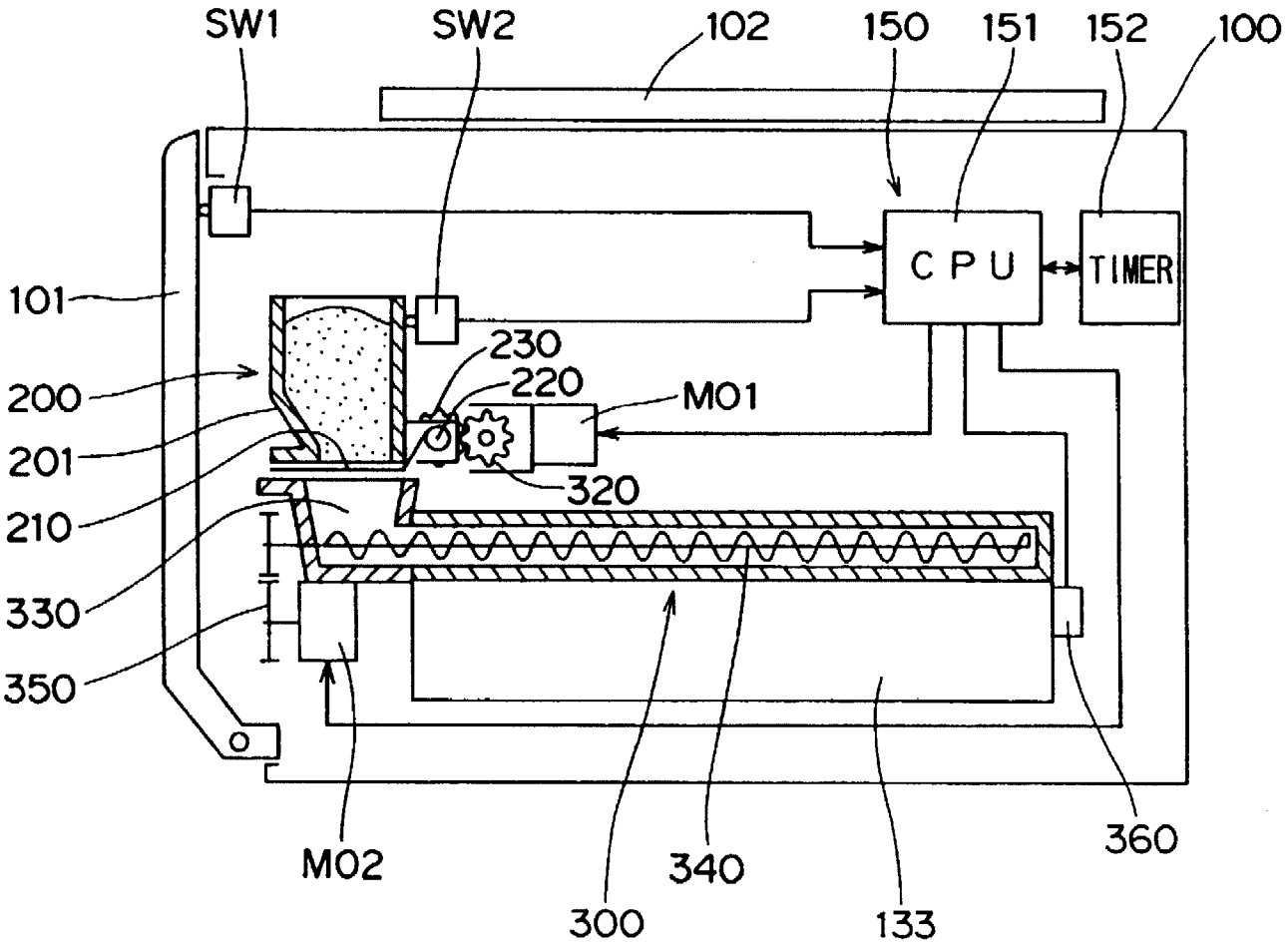
FIG. 3 is a sectional side elevation schematically showing the internal construction of the copying machine shown in FIG. 1.

FIG. 3 is a sectional side elevation showing the schematic construction of the inside of the above-mentioned copying machine. Referring to FIG. 3, the toner cartridge 200 comprises a container-shaped toner cartridge body 201 having a toner dropping opening as a discharge opening for taking out toner on its lower surface, a sheet-shaped sealing member 210 for strippably sealing the toner dropping opening, a winding shaft 220 around which the sealing member 210 is wound, and a driven gear 230 rotated integrally with the winding shaft 220 and rotatably supported on the toner cartridge body 201.

The toner supplying device 300 is provided with a driving gear mechanism 320 which is engaged with the driven gear 230 and a motor MO1 for applying a driving force to the driving gear mechanism 320 as unsealing means of the toner cartridge 200. Further, the toner supplying device 300 comprises a hopper 330 receiving toner dropped from the toner cartridge 200, a screw conveyer 340 serving as conveying means for supplying the toner to the developing device 133 from the hopper 330, a motor MO2 for driving the screw conveyer 340, and a gear mechanism 350 for transmitting the rotation of the motor MO2 to the screw conveyer 340.

When the toner cartridge 200 is in its unused state, the toner dropping opening is sealed by the sealing member 210. When the toner cartridge 200 is used, the toner dropping opening is unsealed in the following manner. That is, when the toner cartridge 200 is set in a predetermined position, the driving gear mechanism 320 and the driven gear 230 are engaged with each other, to enter a state where the driving force of the motor MO1 can be transmitted to the winding shaft 220. When the motor MO1 is driven, the winding shaft 220 is driven to rotate through the driving gear mechanism 320 and the driven gear 230. Correspondingly, the sealing member 210 is wound around the winding shaft 220, whereby the toner dropping opening is unsealed. As a result, the toner contained in the toner cartridge body 201 can be dropped through the toner dropping opening.

The dropped toner is accumulated in the hopper 330. By rotating the motor MO2, therefore, the screw conveyer 340 is driven through the gear mechanism 350, thereby conveying the toner in the hopper 330 toward the developing device 133 and supplying thereto.

The main body 100 is provided with a toner density sensor 360 for detecting a toner density inside the developing device 133 and judging whether or not the developing device 133 is in a state where toner should be supplied thereto, and a switch SW2 serving as toner cartridge mounting detecting means for detecting whether or not the toner cartridge 200 is set in the predetermined position. The switch SW2 is a so-called microswitch provided in the vicinity of the toner cartridge 200 set in the predetermined position. The switch SW2 is arranged so that an actuator of the switch SW2 abuts against an end face of the toner cartridge 200 in a state where it is set. Consequently, a circuit associated with the switch SW2 is closed upon driving of the actuator when the toner cartridge 200 is set, while being opened when the toner cartridge 200 is removed.

The switch SW2, the toner density sensor 360, and the switch SW1 are connected to a control section 150 comprising a CPU 151 and a timer 152. The control section 150 can detect a state where there is not sufficient toner (hereinafter referred to as "toner runs out") in the developing device 133 by comparing an output of the toner density sensor 360 with a predetermined value. That is, the control section 150 judges that toner runs out if the toner density sensor 360 senses a density of less than a predetermined value, while judging that toner does not run out if it senses a density of not less than the predetermined value. The control section 150, along with the toner density sensor 360, thus detects whether or not the developing device 133 is in a state where toner should be supplied thereto, to constitute state outputting means for outputting a signal indicating that toner should be supplied or a signal indicating that toner need not be supplied. The control section 150 can further detect a state where the toner cartridge 200 is mounted depending on the opened or closed state of the switch SW2, and detect the opening or closing of the door 101 depending on the opened or closed state of the switch SW1. The control section 150 controls the motor MO1 and the motor MO2 on the basis of the results of the detection. Thus the control section 150 also has functions of unsealing controlling means and toner supply controlling means.

Control of the toner supplying device 300 by the control section 150 at the time of replacing the toner cartridge with new one will be specifically described.

Figure 4:
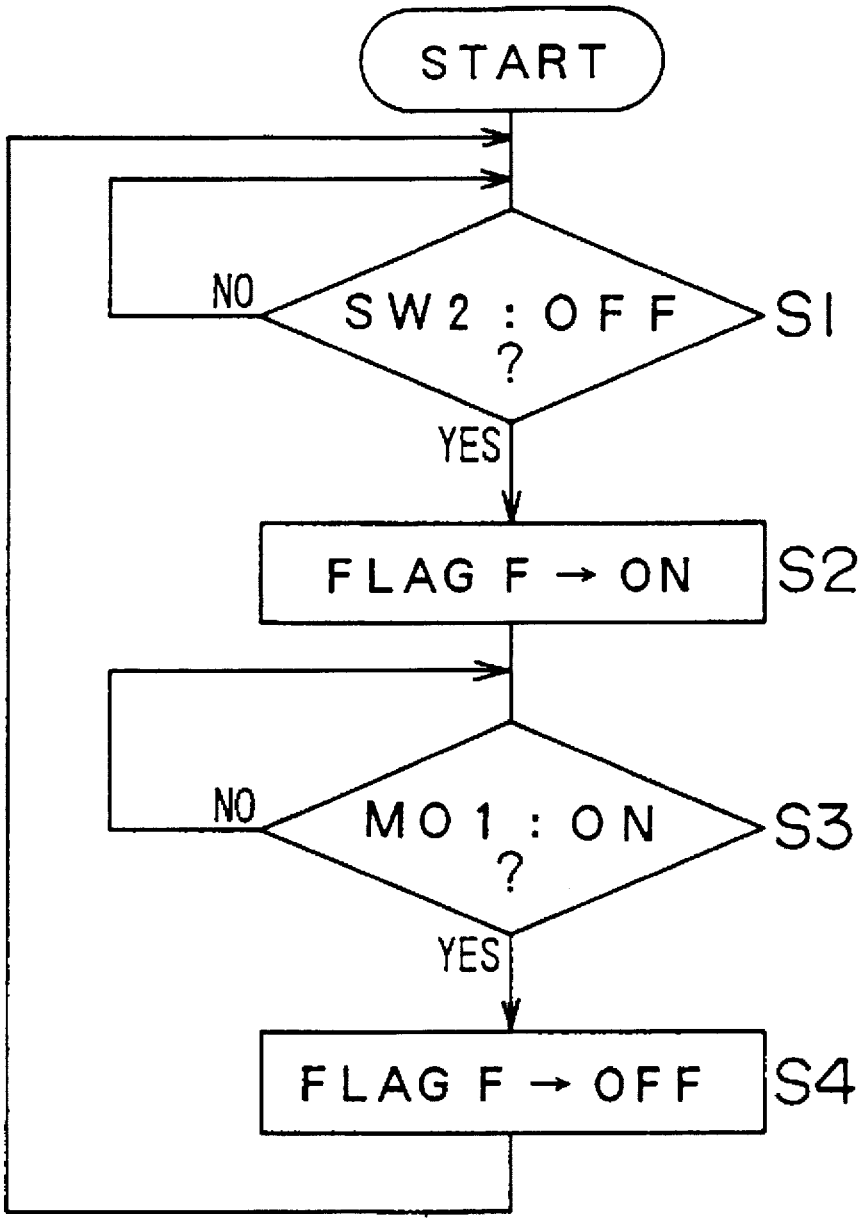
FIG. 4 is a flow chart for explaining the contents of processing performed by a control section.
Figure 5:
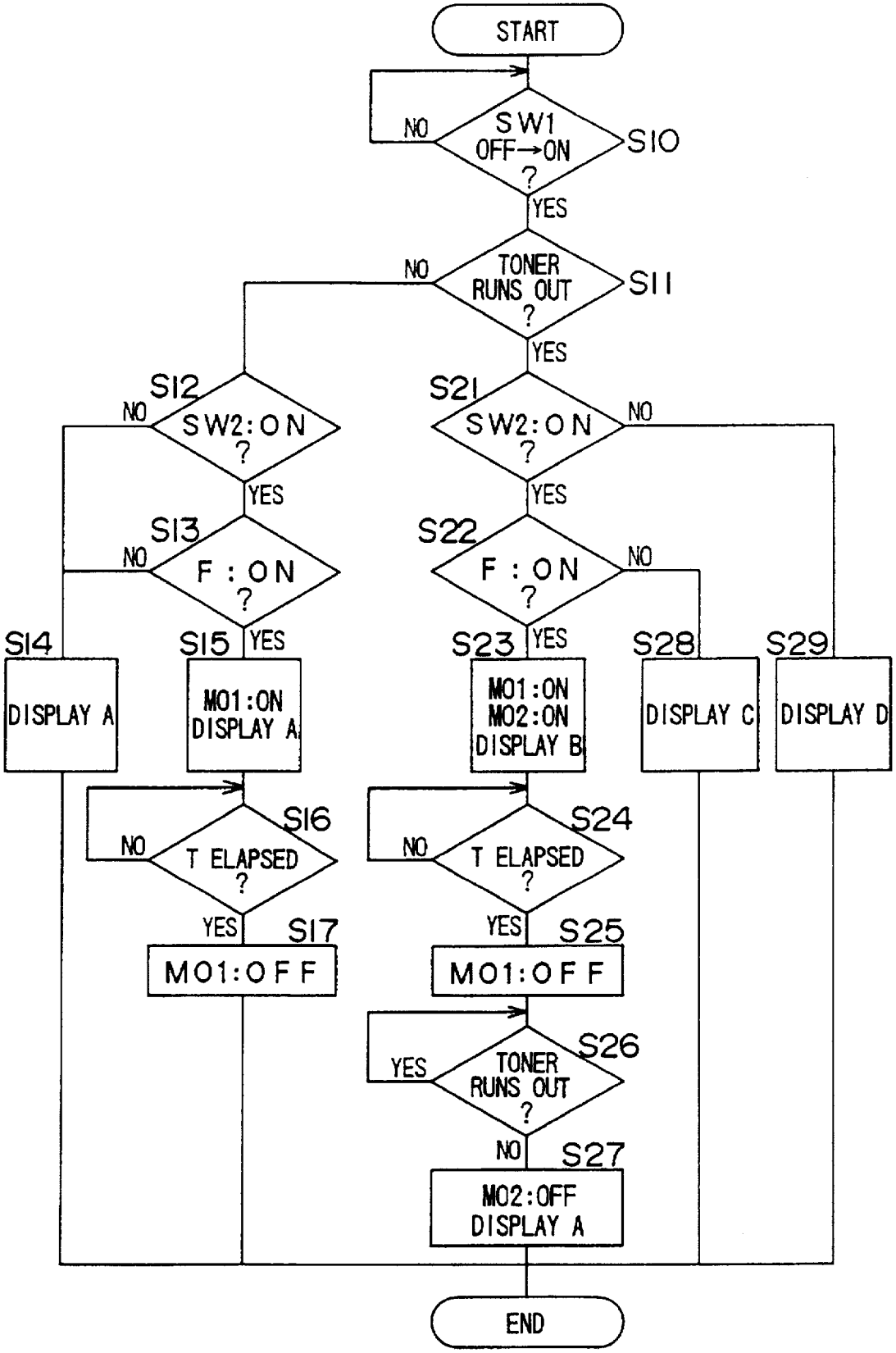
FIG. 5 is a flow chart for explaining the contents of processing performed by the control section.
Figure 6:
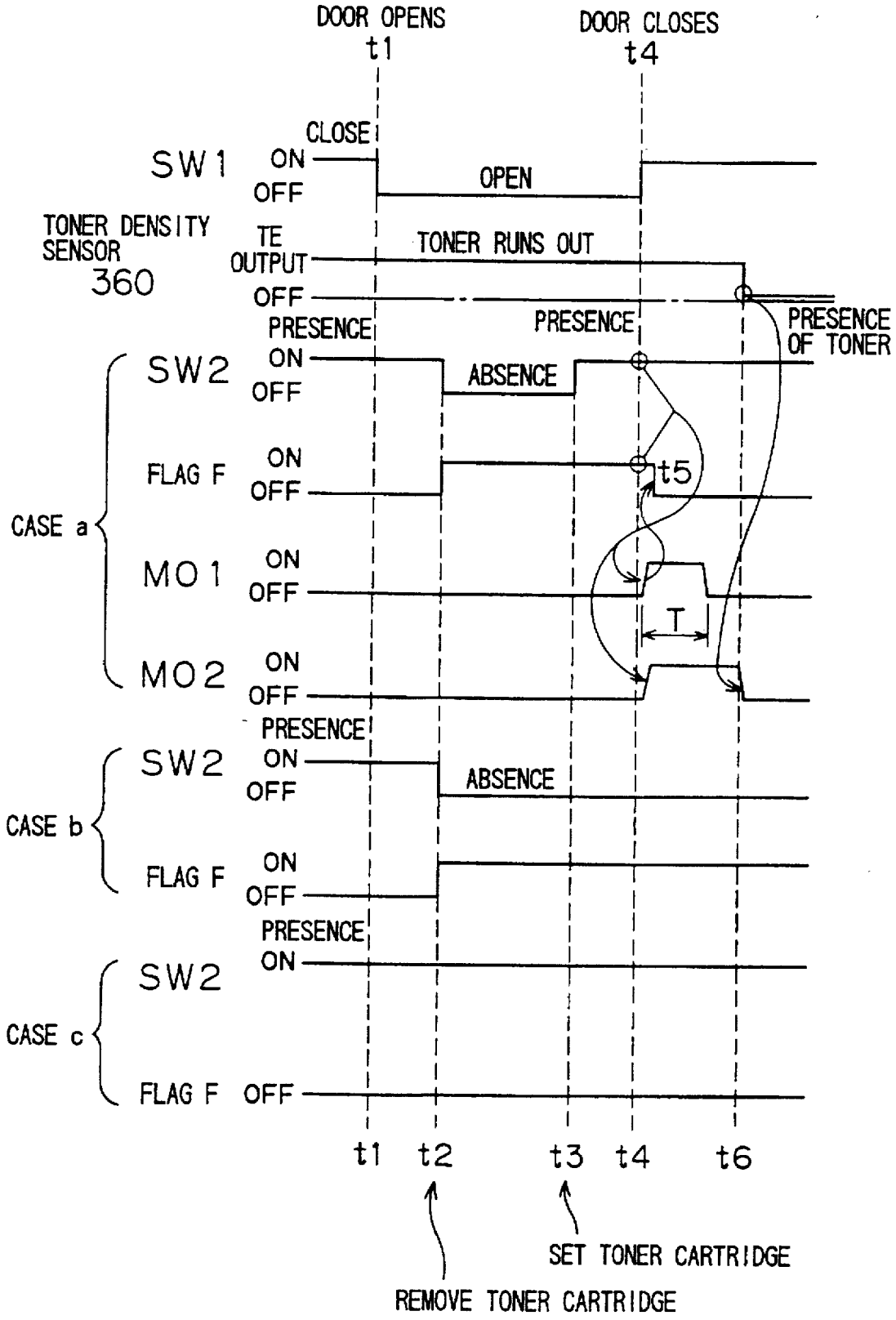
FIG. 6 is a timing chart for explaining a control operation by the control section.

FIGS. 4 and 5 are flow charts for explaining the contents of control processing performed by the control section 150. FIG. 6 is a timing chart for explaining the contents of control by the control section 150.

The following control is carried out when there is a possibility that the toner cartridge 200 is replaced with a new one, that is, when the door 101 is opened and then closed. Referring to FIG. 6, when the door 101 is first opened, the switch SW1 is changed from the on state to the off state (time t1). When it is detected that the door 101 enters the opened state by the switch SW1, processing at the steps S1 to S4 shown in FIG. 4 is performed. This processing is performed in order to judge whether or not the toner cartridge 200 is removed and whether the toner cartridge 200 is not yet unsealed or already unsealed while the door 101 is in the opened state. That is, the function of the unsealing detecting means is realized by the processing at the steps S1 to S4 performed by the control section 150.

(a) Case a—a case where a toner cartridge is replaced with a new one

Referring to FIG. 4 and a portion corresponding to a case a in FIG. 6, when the toner cartridge 200 is removed, the switch SW2 is changed from the on state to the off state. At the step S1, it is examined whether or not the switch SW2 is in the off state, to detect whether or not the toner cartridge 200 is removed. When it is detected that the toner cartridge 200 is removed, a flag F is turned on (step S2) (time t2). The flag F is maintained in the on state until the motor MO1 is driven as described later (step S3), and is turned off when the motor MO1 is driven (step 54) (time t5). If the flag F is in the on state, it can be detected that the toner cartridge 200 is removed. The flag F in the on state corresponds to a signal indicating that the toner cartridge is not yet unsealed. On the other hand, the flag F in the off state corresponds to a signal indicating that the toner cartridge is already unsealed.

When the toner cartridge 200 is removed at the time t2 shown in FIG. 6, and a new toner cartridge 200 is then set, the switch SW2 is changed from the off state to the on state (time t3). The flag F is maintained in the on state as described above. When the door 101 is closed upon completion of the replacement of the toner cartridge 200, the switch SW1 is changed from the off state to the on state (time t4).

(b) Case b—a case where a toner cartridge is only removed

Referring to a portion corresponding to a case b in FIG. 6, description is made of operations in a case where the toner cartridge 200 is only removed, and a new toner cartridge is not mounted. In this case, when the toner cartridge 200 is removed, as in the case a, the switch SW2 is changed from the on state to the off state, and the flag F is turned on (steps S1 and S2) (time t2). Since the toner cartridge 200 is not set thereafter, the door 101 is closed in a state where the switch SW2 is in the off state and the flag F is in the on state, whereby the switch SW1 is changed from the off state to the on state (time t4).

(c) Case c—a case where a toner cartridge is not removed

Referring to a portion corresponding to a case c in FIG. 6, description is made of operations in a case where the door 101 is only opened or closed, and the toner cartridge 200 is not removed. In this case, the toner cartridge 200 is not removed while the door 101 is in the opened state, whereby the switch SW2 is maintained in the on state, and the flag F is in the off state (step S1). In this state, the door 101 is closed, whereby the switch SW1 is changed from the off state to the on state (time t4).

In the cases a, b, and c, when the door 101 is closed, processing shown in FIG. 5 is performed. That is, at the step S10, the change of the switch SWI from the off state to the on state at the time t4 is detected, whereby processing for controlling the toner supplying device 300 is started.

At the step S11, the toner density sensor 360 senses whether or not toner has run out. When it is not sensed that toner has run out, processing at the steps S12 to S17 described in relation to the following case d is performed. When it is sensed that toner has run out, processing at the steps S21 to S29 described in relation to the following case e is performed.

(d) Case d—a case where it is not sensed that toner has run out

At the step S12, it is determined whether or not the toner cartridge 200 is set depending on whether the switch SW2 is in the on state or the off state. Further, when the switch SW2 is in the on state, it is determined at the step S13 whether or not the toner cartridge 200 is removed once depending on whether the flag F is in the on state or the off state. If the toner cartridge 200 is removed once, it can be judged that the mounted toner cartridge 200 is a new one after replacement. Consequently, it can be judged that the toner cartridge 200 is not yet unsealed. On the contrary, if the toner cartridge 200 is not removed, because the flag F is in the off state, it can be judged that the toner cartridge 200 is already unsealed.

When the switch SW2 is in the off state at the step S12 (the foregoing case b), or the flag F is in the off state at the step S13 (the foregoing case c), a message "Copying is possible (continuous copying is possible)." (the display of this message is hereinafter referred to as "display A") is outputted to the display device 153 (step S14), after which the processing is terminated.

When the flag F is in the off state at the step S13, that is, when the switch SW2 is in the on state, and the flag F is in the on state (the foregoing case a), the mounted toner cartridge 200 is a new one after replacement, whereby it can be judged that the toner cartridge is not yet unsealed. The motor MO1 is driven upon the judgment, whereby the toner cartridge 200 is unsealed. The flag F is turned off by a command to drive the motor MO1 (time t5, steps S3 to S4 in FIG. 4). The above-mentioned display A is outputted to the display device 153 (step S15). The motor MO1 is driven for a predetermined time T, and is then stopped (steps S16 and S17), after which the processing is terminated.

When it is not sensed that toner has run out, an output signal of the toner density sensor 306 is as indicated by a one-dot and dash line in FIG. 6. In this case, since toner need not be supplied, the motor MO2 is not driven.

The above-mentioned predetermined time T is set to a time during which the sealing member 210 can be wound around the winding shaft 220 by the driving of the motor MO1.

(e) Case e—a case where it is sensed that toner has run out

At the step S21, it is determined whether or not the toner cartridge 200 is set depending on whether the switch SW2 is in the on state or the off state. Further, when the switch SW2 is in the on state, it is determined at the step S22 whether or not the toner cartridge 200 is removed once and whether the toner cartridge 200 is not yet unsealed or already unsealed depending on whether the flag F is in the on state or the off state.

When the flag F is in the on state at the step S22, that is, when the switch SW2 is in the on state, and the flag F is in the on state (the foregoing case a), it can be judged that the mounted toner cartridge 200 is a new one which has not yet been unsealed after replacement. The motor MO1 is driven upon the judgment, whereby the toner cartridge 200 is unsealed, and the flag F is turned off (time t5). The motor MO2 is also driven, whereby toner is conveyed to the developing device 133. Further, a message "Please wait for a moment. Toner is being supplied." (the display of this message is hereinafter referred to as "display B") is outputted to the display device 153 (step S23). The motor MO1 is driven for the predetermined time T, and is then stopped (steps S24 and S25). The motor MO2 is driven until the toner density sensor 360 does not sense that toner has run out (step S26). When the toner is supplied to the developing device 133 by the driving of the motor MO2, until finally the toner density sensor 360 does not sense that toner has run out, the motor MO2 is stopped (time t6). At the same time, the above-mentioned display A is outputted to the display device 153 (step S27), after which the processing is terminated. See the portion corresponding to the case a in FIG. 6.

In a case where the flag F is in the off state at the step S22 (the foregoing case c), a message "Copying is possible.

Please supply toner. (single copy mode)" (the display of this message is hereinafter referred to as "display C") is outputted to the display device 153 (step S28), after which the processing is terminated.

When the switch SW2 is in the off state at the step S21 (the foregoing case b), a message "Copying is possible. Please set a cartridge. (single copy mode)" (the display of this message is hereinafter referred to as "display D") is outputted to the display device 153 (step S29), after which the processing is terminated.

In a case where the toner cartridge 200 is not set, it is considered that toner runs out in a short time. When toner has run out, however, other processing corresponding thereto is performed. Therefore, it is practically safe to display "Copying is possible. . . . " at the steps S14 and S29.

In the copying machine, in a case where the toner cartridge 200 is not set when the power supply is turned on, the flag F is set to the on state. If the door 101 is opened in a case where the toner cartridge 200 is not set, and the door 101 is closed upon setting of the toner cartridge, therefore, the switch SW2 is turned on, and the flag F is in the on state, whereby the same processing as that performed when the toner cartridge 200 is replaced with a new one (the foregoing case a) is performed, after which the steps S12 to S17 or the steps S21 to S27 are carried out.

According to the present embodiment, it is possible to judge three types of cases, that is, a case where the toner cartridge is replaced with a new one (the case a), a case where the toner cartridge is removed, but a new toner cartridge is not set (the case b), and a case where the toner cartridge is not replaced with new one (the case c), whereby the respective devices can be suitably driven when required. Specifically, the operation of the motor MO2 which is to be a driving source of the toner conveying means is performed when the toner cartridge 200 is replaced with a new one, and the toner density sensor 360 senses that toner has run out, while the motor MO2 is not operated when the toner cartridge 200 is not replaced. The operation of the motor MO1 which is unsealing means is performed only when the toner cartridge 200 is replaced, while the motor MO1 is not operated when the toner cartridge 200 is not replaced with a new one.

Furthermore, the above-mentioned motor MO1 which is unsealing means can be operated irrespective of the output of the toner density sensor 360. Therefore, the toner cartridge 200 can be replaced when there is sufficient toner, that is, well before it is sensed that toner has run out.

Since it can be detected that the toner cartridge 200 is replaced by the switch SW2 for detecting the set state of the toner cartridge 200 and the processing at the steps S1 to S4, a sensor for sensing that the toner cartridge 200 is replaced need not be separately provided. Further, construction for sensing the replacement can be simplified.

Furthermore, the toner cartridge 200 can be replaced with a new one before it is sensed that toner has run out. When it is expected that toner will run out in a short time, for example, when there is no toner left and toner is running short inside the toner cartridge 200, therefore, the toner cartridge 200 can be replaced. This is particularly preferable for the improvement of service in a copying machine employed in a copy service shop or the like because this can prevent a report that toner has run out during the use and waiting for time required to replace the toner cartridge. In this case, if the toner cartridge 200 is constructed so that it can easily confirm how much toner is left in the toner cartridge 200, for example, if the material of the toner cartridge 200 is made transparent or translucent, this is more preferable because the time when the toner cartridge 200 should be replaced can be easily judged.

Although description was made of the present embodiment, it goes without saying that the present invention has other embodiments. For example, although in the above-mentioned embodiment, unsealing control of the toner cartridge and the toner supply are carried out on the basis of the opening or closing of the door 101, the opening or closing of the door 101 and the controls need not be necessarily related to each other. For example, unsealing control and control of toner supply may be carried out after an elapse of a predetermined time since an output of the switch SW2 has changed from a signal indicating that the toner cartridge is not mounted to a signal indicating that the toner cartridge is mounted. Alternatively, unsealing control and control of toner supply may be started in response to the performance of a predetermined input operation to be performed after completion of cartridge replacing work, for example, depression of a print key after it is detected that the toner cartridge has been replaced.

Although in the above-mentioned embodiment, description has been made by taking an analog type copying machine as an example, the present invention is also applicable to other apparatuses for forming an image by an electrophotographic system, for example, a digital type copying machine, a laser printer, and a plain paper facsimile.

Although the present invention has been described and illustrated in detail, it is clearly understood that the description is by way of illustration and example only and is not to be taken by way of limitation, the spirit and scope of the present invention being limited only by the terms of the appended claims.

What is claimed is:

1. An image forming apparatus comprising:

a developing device;

a toner supplying device for supplying toner to the developing device, the toner supplying device being capable of removably mounting a toner cartridge containing toner and having a discharge opening for taking out the toner, the discharge opening being unsealably sealed;

unsealing means for unsealing the discharge opening of the toner cartridge mounted on the toner supplying device;

toner cartridge mounting detecting means for detecting that the toner cartridge is mounted on the toner supplying device;

unsealing detecting means for outputting a signal indicating whether the toner cartridge mounted on the toner supplying device has not yet been unsealed or already unsealed;

unsealing controlling means for operating the unsealing means in order to unseal the discharge opening of the toner cartridge, provided that the toner cartridge mounting detecting means detects that the toner cartridge is mounted, and the unsealing detecting means outputs a signal indicating that the toner cartridge has not yet been unsealed;

a door opened when the toner cartridge is removed or mounted;

opening/closing detecting means for detecting whether the door is in an opened state or a closed state; and means for starting control of the unsealing means by the unsealing controlling means in response to a detection that the door is changed from the opened state to the closed state by the opening/closing detecting means.

2. An image forming apparatus according to claim 1, further comprising:

state outputting means for determining whether or not the developing device is in a state where toner should be supplied thereto and outputting a signal indicating that toner should be supplied or a signal indicating that toner need not be supplied; and toner supply controlling means for driving the toner supplying device in order to supply toner to the developing device, provided that the state outputting means outputs the signal indicating that toner should be supplied.

3. An image forming apparatus according to claim 2, wherein the toner supply controlling means drives the toner supplying device in order to supply toner to the developing device, provided that the toner cartridge mounting detecting means detects that the toner cartridge is mounted, and the unsealing detecting means outputs the signal indicating the toner cartridge has not yet been unsealed.

4. An image forming apparatus according to claim 2, wherein the state outputting means includes:

toner density detecting means for detecting a toner density inside the developing device; and signal outputting means for outputting the signal indicating that toner should be supplied if the toner density detecting means detects a toner density of less than a predetermined value, while outputting the signal indicating that toner need not be supplied if the toner density detecting means detects a toner density of not less than the predetermined value.

5. An image forming apparatus according to claim 1, wherein the unsealing detecting means outputs the signal indicating that the toner cartridge has not yet been unsealed, until the unsealing means unseals the discharge opening upon being controlled by the unsealing controlling means, in response to a change of an output of the toner cartridge mounting detecting means from a state where it is detected that the toner cartridge is mounted to a state where it is detected that the toner cartridge is not mounted.

6. An image forming apparatus according to claim 1, wherein the toner cartridge mounting detecting means includes a switch having an actuator which is operated in a state where the toner cartridge is mounted on the toner supplying device.

7. A method of supplying toner to a developing device in an image forming apparatus, comprising the steps of:

providing toner cartridge mounting detecting means for detecting a toner cartridge mounted in a predetermined position;

judging that a toner cartridge to be next mounted is a new cartridge which has not yet been unsealed based on a change of an output of the toner cartridge mounting detecting means from a signal indicating that the toner cartridge is mounted to a signal indicating that the toner cartridge is not mounted; and unsealing the toner cartridge if the toner cartridge mounting detecting means detects that the toner cartridge is mounted, and it is judged that the mounted toner cartridge has not yet been unsealed;

wherein the toner cartridge unsealing step is carried out in response to closing of a door which is opened when the toner cartridge is removed or mounted.

8. A method according to claim 7, further comprising the steps of:

detecting a toner density inside the developing device; and supplying toner to the developing device if the toner density is less than a predetermined value.

9. A method according to claim 8, wherein the toner supplying step is carried out, provided that the toner cartridge mounting detecting means detects that the toner cartridge is mounted, and that it is judged that the toner cartridge has not yet been unsealed.

10. An image forming apparatus comprising:

a developing device;

a toner supplying device for supplying toner to the developing device, the toner supplying device being capable of removably mounting a toner cartridge containing toner and having a discharge opening for taking out the toner, the discharge opening being unsealably sealed;

unsealing means for unsealing the discharge opening of the toner cartridge mounted on the toner supplying device;

toner cartridge mounting detecting means for detecting that the toner cartridge is mounted on the toner supplying device;

unsealing detecting means for outputting a signal indicating whether the toner cartridge mounted on the toner supplying device has not yet been unsealed or already unsealed;

unsealing controlling means for operating the unsealing means in order to unseal the discharge opening of the toner cartridge, provided that the toner cartridge mounting detecting means detects that the toner cartridge is mounted, and the unsealing detecting means outputs a signal indicating that the toner cartridge has not yet been unsealed;

state outputting means for determining whether or not the developing device is in a state where toner should be supplied thereto and outputting a signal indicating that toner should be supplied or a signal indicating that toner need not be supplied;

toner supply controlling means for driving the toner supplying device in order to supply toner to the developing device, provided that the state outputting means outputs the signal indicating that toner should be supplied, wherein the toner supply controlling means drives the toner supplying device in order to supply toner to the developing device, provided that the toner cartridge mounting detecting means detects that the toner cartridge is mounted, and the unsealing detecting means outputs the signal indicating the toner cartridge has not yet been unsealed.

11. An image forming apparatus according to claim 10, wherein the state outputting means includes:

toner density detecting means for detecting a toner density inside the developing device; and signal outputting means for outputting the signal indicating that toner should be supplied if the toner density detecting means detects a toner density of less than a predetermined value, while outputting the signal indicating that toner need not be supplied if the toner density detecting means detects a toner density of not less than the predetermined value.

12. An image forming apparatus according to claim 10, wherein the unsealing detecting means outputs the signal indicating that the toner cartridge has not yet been unsealed, until the unsealing means unseals the discharge opening upon being controlled by the unsealing controlling means, in response to a change of an output of the toner cartridge mounting detecting means from a state where it is detected that the toner cartridge is mounted to a state where it is detected that the toner cartridge is not mounted.

13. An image forming apparatus according to claim 10, wherein the toner cartridge mounting detecting means includes a switch having an actuator which is operated in a state where the toner cartridge is mounted on the toner supplying device.

14. A method of supplying toner to a developing device in an image forming apparatus, comprising the steps of:

providing toner cartridge mounting detecting means for detecting a toner cartridge mounted in a predetermined position;

judging that a toner cartridge to be next mounted is a new cartridge which has not yet been unsealed based on a change of an output of the toner cartridge mounting detecting means from a signal indicating that the toner cartridge is mounted to a signal indicating that the toner cartridge is not mounted;

unsealing the toner cartridge if the toner cartridge mounting detecting means detects that the toner cartridge is mounted, and it is judged that the mounted toner cartridge has not yet been unsealed;

detecting a toner density inside the developing device; and supplying toner to the developing device if the toner density is less than a predetermined value, wherein the toner supplying step is carried out, provided that the toner cartridge mounting detecting means detects that the toner cartridge is mounted, and that it is judged that the toner cartridge has not yet been unsealed.

* * * * *